United States Patent [19]

Nikaido et al.

[11] Patent Number: 5,019,010

[45] Date of Patent: May 28, 1991

[54] TRANSFORMABLE BLOCK TOYS

[75] Inventors: Teruo Nikaido; Ichiro Ohi, both of Tokyo, Japan

[73] Assignee: Tomy Company, Ltd., Tokyo, Japan

[21] Appl. No.: 338,851

[22] Filed: Apr. 17, 1989

[30] Foreign Application Priority Data

Apr. 15, 1988 [JP] Japan ..... 63-50559[U]
Jan. 23, 1989 [JP] Japan ..... 1-6146[U]

[51] Int. Cl.[5] ..... A63H 33/00; A63H 3/46; A63H 17/00

[52] U.S. Cl. ..... 446/487; 446/230; 446/376; 446/470

[58] Field of Search ..... 446/487, 465, 470, 457, 446/230, 231, 93–96, 85; 273/153 S

[56] References Cited

U.S. PATENT DOCUMENTS

| | | | |
|---|---|---|---|
| Re. 16,411 | 8/1926 | Stephens . | |
| 4,377,916 | 3/1983 | Komiya | 446/487 |
| 4,393,620 | 7/1983 | Murakami | 446/470 |
| 4,411,097 | 10/1983 | Murakami | 446/487 X |
| 4,477,999 | 10/1984 | Harigai et al. | 446/470 |
| 4,605,383 | 8/1986 | Horiuchi | 446/487 X |
| 4,673,373 | 6/1987 | Herring et al. | 446/487 X |

FOREIGN PATENT DOCUMENTS

| | | | |
|---|---|---|---|
| 2559072 | 8/1985 | France | 446/487 |
| 2059785 | 4/1981 | United Kingdom | 446/470 |
| 2060414 | 5/1981 | United Kingdom | 446/470 |
| 2088733A | 6/1982 | United Kingdom . | |
| 2120111A | 11/1983 | United Kingdom . | |
| 2135591 | 9/1984 | United Kingdom | 446/93 |
| 2142608A | 1/1985 | United Kingdom . | |

*Primary Examiner*—Mickey Yu
*Attorney, Agent, or Firm*—Staas & Halsey

[57] ABSTRACT

A transformable block toy includes a main body segment and at least one movable segment movably connected to the main body segment and being movable between retracted and extended positions. The main body segment and the movable segment form a building block having a geometric shape when the movable segment is in the retracted position and a vehicle or animal when in the extended position. A variety of geometric shapes and vehicle types are formed in different embodiments of the invention.

7 Claims, 14 Drawing Sheets

TRANSFORMABLE BLOCK TOYS

BACKGROUND OF THE INVENTION

1. Field of the Invention

The present invention relates generally to block toys, and more specifically, to block toys which have movable parts which enable them to be transformable into vehicles.

2. Description of the Related Art

Building blocks are a type of toy intended for play by young children. It has been observed that children playing with building blocks often use the blocks to emulate vehicles, such as automobiles, trains, airplanes, etc. These building blocks are usually in the form of basic geometric shapes, such as a cube, disc, polyhedron, trapezohedron, etc.

It has also been observed that children playing with building blocks use them as other kinds of toys such as dolls and floor toys.

Building blocks of common geometric shape have not heretofore been physically transformable into other types of toys.

SUMMARY OF THE INVENTION

An object of the present invention is to provide building blocks of various geometric shapes which are transformable into vehicles. Another object of the invention is to provide a building block toy which is transformable from a basic geometric shape to a shape which resembles a vehicle, such as an automobile, train, truck, airplane, etc.

Another object of the invention is to provide a building toy which is transformable from a basic geometric shape to a shape which resembles an animal, such as an elephant, bear, cat, etc.

Another object of the invention is to provide a toy which is durable, safe, and inexpensive to produce.

In a preferred embodiment of the invention, a transformable block toy includes a body member having at least two substantially planar parallel outer surfaces and at least one movable segment of the body member which is movable between retracted and extended positions. In one embodiment, the body member has a geometric shape when the movable body segment is in the retracted position and a vehicle shape when the body segment is in the extended position. In another embodiment, the body member has an animal shape when the body segment is in the extended position. The body member may have a variety of geometric shapes, including a cube, polyhedron, disc, trapezohedron, etc. The movable body segments either conform to the geometric shape of the body member in the retracted position, fold or retract into the body member.

These objects, together with other objects and advantages which will be subsequently apparent reside in the details of construction and operation of the transformable block toys as more fully hereinafter described and claimed, reference being had to the accompanying drawings forming a portion hereof, wherein like reference numerals refer to like parts throughout.

DETAILED DESCRIPTION OF THE PREFERRED EMBODIMENTS

Figure 1:
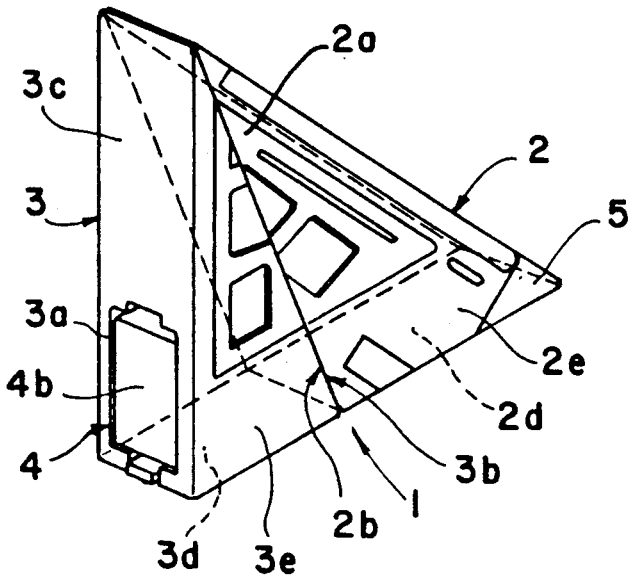
FIG. 1 is a perspective view of a first preferred embodiment of the present invention in a building block mode having a geometric shape.

FIG. 1 illustrates a transformable block toy or building block which has a body member 1 which has a basic geometric shape of a polyhedron. The body member 1 is preferably a trihedron made of two triangular body segments 2 and 3 which are pivotally connected by a pivotal joint (not shown) between opposing surfaces 2*b* of segment 2 and 3*b* of segment 3. Segment 3 is rotatably movable relative to segment 2 (or visa versa). When segment 3 is rotated 180° from the position shown in FIG. 1 to the position shown in FIG. 2, the trihedron geometric shape is transformed into the shape of a vehicle (a train). Segment 3 is a right triangle having perpendicular surfaces 3*c* and 3*d*. Surface 3*d* of segment 3 is substantially coplanar with surface 2*d* of segment 2 when the body member 1 is in the geometric shape of FIG. 1. Also, surface 3*e* of segment 3 is coplanar with surface 2*e* of segment 2. Together, surfaces 2*e* and 3*e* form a triangularly shaped outer surface of the body member 1 which is substantially planar and parallel to a triangularly shaped surface on the opposite side of the body member 1.

Figure 2:
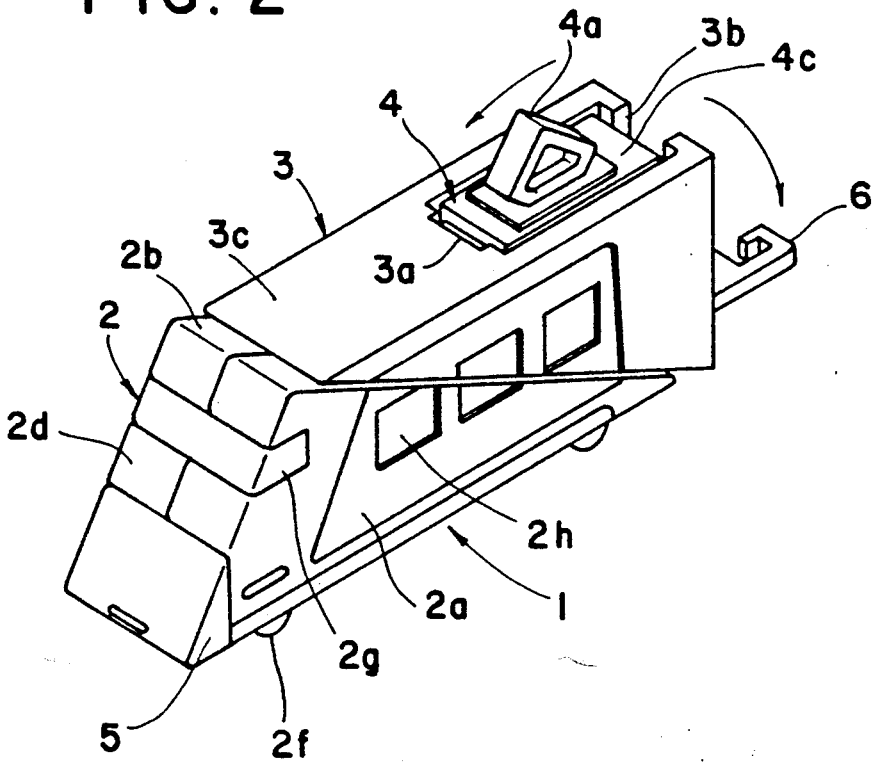
FIG. 2 is a perspective view of the first preferred embodiment of FIG. 1 transformed into a vehicle.

Surface 3*c* of segment 3 is provided with a recess 3*a* in which a rotatable member 4 is rotatably mounted. When the block toy is in the geometric shape shown in FIG. 1, the rotatable member 4 is rotated such that a planar surface 4*b* is substantially coplanar with surface 3*c* of the segment 3. When transforming the block toy to the shape illustrated in FIG. 2, the rotatable member 4 is rotated 180° such that an opposite side surface 4*c* is substantially coplanar with surface 3*c* and a projection 4*a* extends upwardly from the surface 4*c*. The directional arrow in FIG. 2 depicts the rotational movement of the rotatable member 4. Retraction of the rotatable member back into segment 3 requires rotation in a direction opposite that of the directional arrow. Projection 4*a* is preferably pantograph-like in appearance.

As shown in FIG. 2, the body segments 2 and 3, each of which is basically wedge shaped, form in combination a nearly rectangular parallelopiped of which the forward end or tip is streamlined like a high speed train. A coupler 6 is recessed in the surface 3*d* of segment 3 when the block toy is disposed in the geometric shape of FIG. 1. When transforming the block toy to the vehicle mode of FIG. 2, the coupler 6 is pivoted outwardly from its recess 3*d* to enhance the image of a train.

Optionally, four wheels 2*f* are rotatably mounted in the segment 2. The wheels protrude slightly beyond the bottom surface of the segment 2 so that the block toy can be rolled on a floor or other suitable surface.

A whistle 5 may be provided in the nose of the train after transformation. Other train-like features may be formed in the two segments 2 and 3, such as a windshield 2*g* and windows 2*h*. These additional features may be made of separate pieces which are snap fitted into place, but all have surfaces which are substantially coplanar with the outer surfaces of the transformed structure. However, the windows 2*h* are, as illustrated, slightly recessed.

Figure 3:
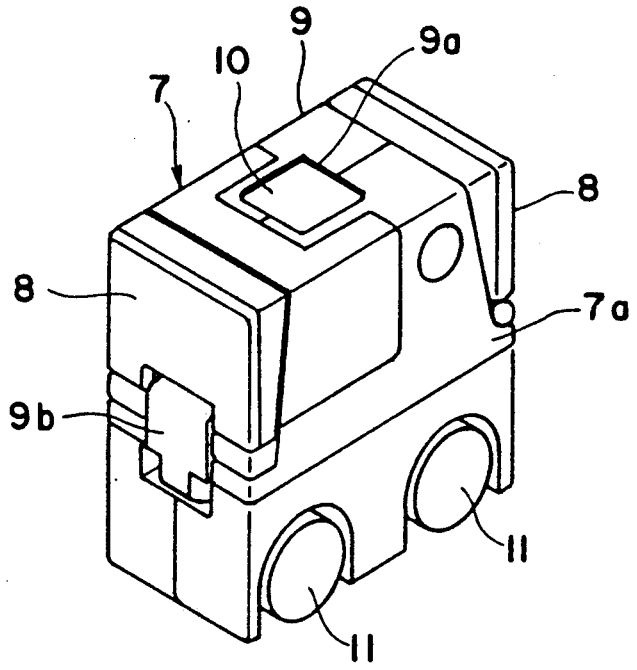
FIG. 3 is a perspective view of a second preferred embodiment of the present invention in a building block mode and having a geometric shape.

FIG. 3 illustrates a second embodiment of a building block in which a body member 7 has a substantially quadrahedron shape. Two movable segments are pivotally connected to opposite sides of a main body segment 9 at upper forward and upper rearward portions thereof. The pivotal connection is facilitated by links 9*b* which are spring biased by springs (not shown) disposed in the links, such that the movable segments 8 are spring biased into both the retracted position shown in FIG. 3 and the extended position shown in FIG. 4. Due to the fact that the links 9*b* do not have a fixed rotational axis within the main body segment 9, a sliding action is facilitated in which the movable segments 8 are disposed in a flush position relative to the main body segment 9 in either the retracted or extended positions.

The quadrahedron-shaped building block of FIG. 3 is transformed into an automobile-shaped vehicle in which the links 9*b* form a part of the contoured outer surface of the automobile by fitting flush with horizontal surfaces spaced upwardly from the base of the vehicle.

A vertical passageway 9*a* which extends from the upper surface of the main body segment 9 to the lower surface slidably receives a sliding member 10, which is illustrated in FIG. 3 in a retracted position flush with the upper surface of the main body segment 9. When the building block is converted into an automobile, the sliding member 10 is caused to extend upwardly by pushing on the lower end thereof such that an upper end portion of the sliding member 10 extends beyond the upper surface of the main body portion 9. In this extended position, the upper end portion resembles an alarm lamp or "bubble" of a patrol car.

The bottom portion of the body member 7 rotatably supports four wheels 11 which extend slightly below the bottom surface, but are substantially flush with the rectangular outer surface 7*a* of the body member 7. Thus, the wheels 11 do not substantially detract from the overall quadrahedron shape of the block toy prior to transformation.

Basically, the movable segments 8 are foldable by virtue of each pivoting on its respective link 9*b*, while each link 9*b* pivotally moves relative to the main body segment 9. Similar to the embodiment of FIGS. 1 and 2, various other aspects of the vehicle illustrated in FIG. 4 can be formed in the body segments, such as headlights and a grill formed on the forward movable segment 8, and a windshield which may be separately formed as a body panel and snap-fitted into place during assembly. The wheels 11 may optionally be provided with a noise-making mechanism which creates a clicking sound as the wheels rotate. The noise-making mechanism need only be provided with respect to one set of wheels.

Figure 4:
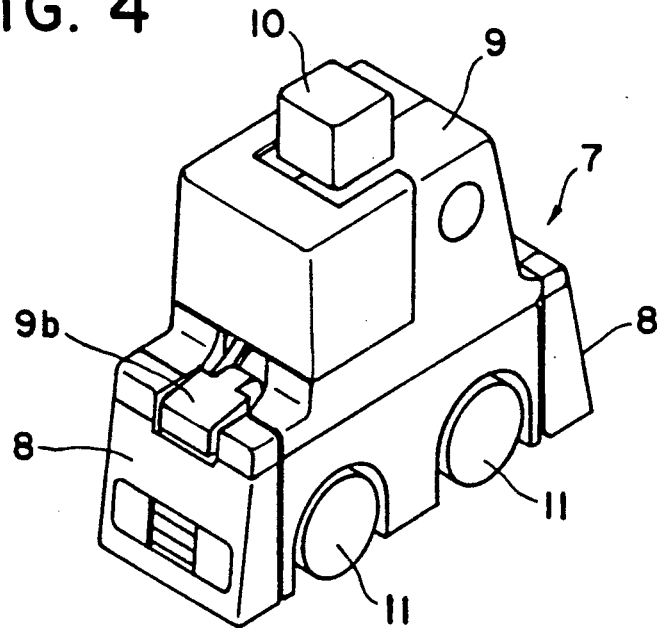
FIG. 4 is a perspective view of the second preferred embodiment of FIG. 3 transformed into a vehicle.
Figure 5:
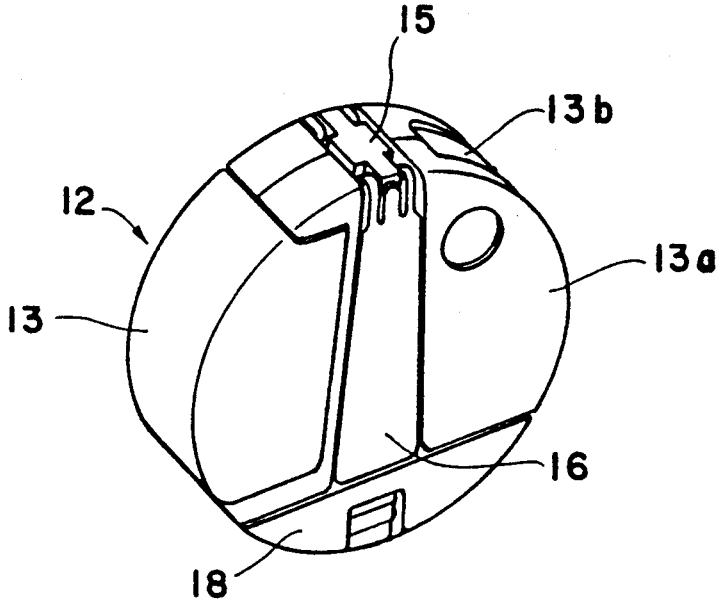
FIG. 5 is a perspective view of a third preferred embodiment of the present invention in a building block mode and having a geometric shape.
Figure 6:
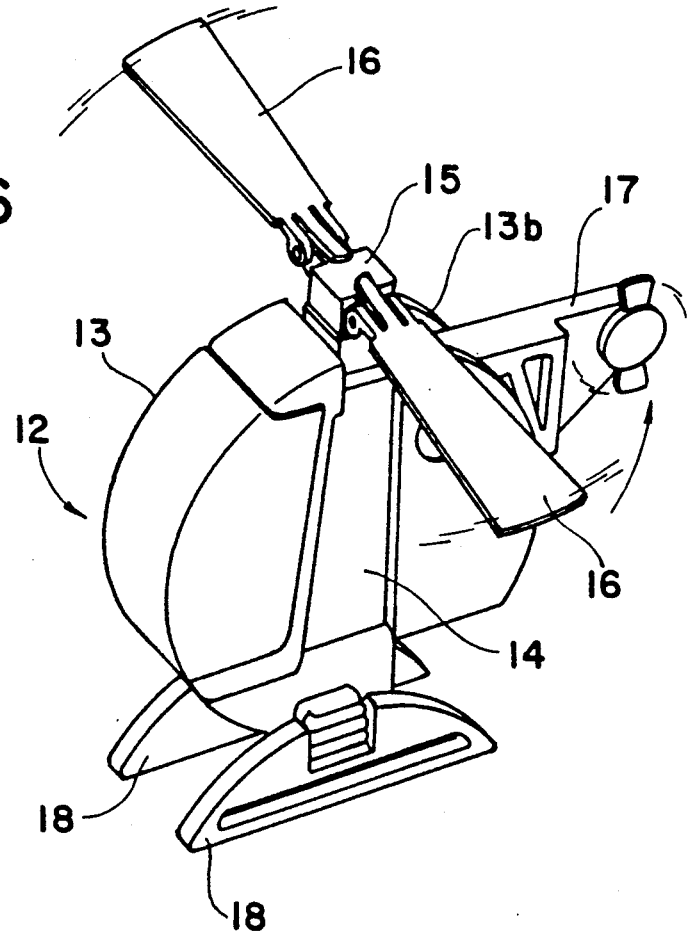
FIG. 6 is a perspective view of the third preferred embodiment of FIG. 5 transformed into a vehicle.

FIG. 5 illustrates a third embodiment of the invention in which a building block includes a body member 12 which is substantially disc-shaped. Two substantially planar, parallel, circular outer surfaces 13*a* are spaced apart by a radial sidewall 13. A retractable member 15 has an outer surface which is substantially flush with the radial sidewall 13 of the body member 12 when formed in the disc-like geometric shape of FIG. 5. The retractable member 15 pivotally supports two, opposite side movable segments 16 which, in the retracted position of FIG. 4, have outer surfaces which are substantially flush with the circular outer surfaces 13*a* of the body member 12. From the retracted position of FIG. 5, the movable segments 16 are pivoted outwardly away from the surfaces 13*a* of the body member 12 until the outer surfaces of the movable segments 16 are substantially coplanar with the upper surface of the retractable member 15. Then, the retractable member 15 is pushed radially outwardly to achieve a position illustrated in FIG. 6. The movable segments are helicopter rotors which are free to rotate by virtue of an upper portion of the retractable member 15 which is pivotally connected to a lower portion. The lower portion has an upper surface which is substantially flush with the radial sidewall 13 when the movable segments 16 are retracted and the retractable member 15 is extended outwardly. Basically, the movable segments 16 become disposed on top of a helicopter-like body which was transformed from the disc-shaped body member 12.

A slot 13*d* formed in the radial sidewall 13 receives a tail section 17 of the helicopter and is pivotally mounted therein. The tail section 17 moves from the retracted position of FIG. 5 to the extended position of FIG. 6 by pivotal upward movement as indicated by the directional arrow in FIG. 6.

The movable segments or rotors 16 are fitted into recesses 14 formed in the circular side surfaces 13*a* of the body member 12. The surfaces 13*a* are also provided with recesses at bottom portions thereof for receiving foot elements 18 which pivot into the recesses in the retracted position illustrated in FIG. 5, and are capable of pivoting 180° to provided flat support surfaces for the body member. Basically, the foot elements 18 are foldable into retracted and extended positions. The body member 12 may also be provided with body parts which resemble other components of a helicopter, such as a windshield.

Figure 7:
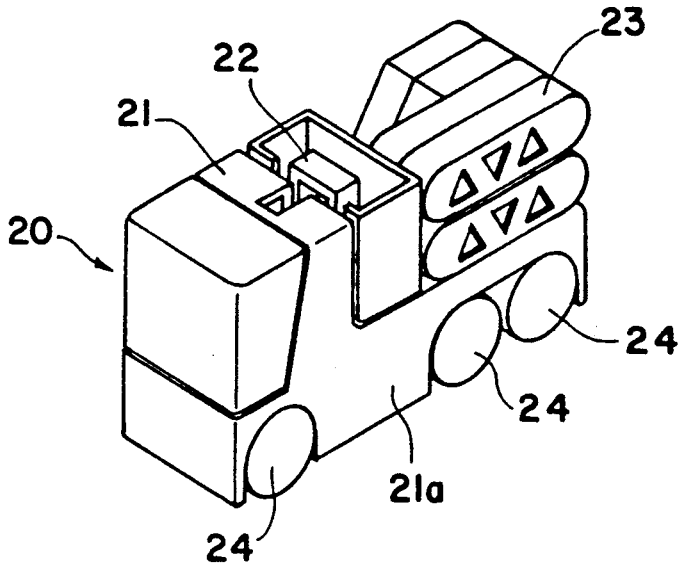
FIG. 7 is a perspective view of a fourth preferred embodiment of the present invention in a building block mode and having a geometric shape.

FIG. 7 illustrates a fourth embodiment of the invention in which a building block has a body member 20 which is substantially polyhedron-shaped. The body member 20 has a main body segment 21 and a movable segment 23 which, in FIG. 7, is in a retracted position such that the movable segment 23 and the main body segment 21 form a building block having the geometric shape of a quadrahedron. The body member 20 has two substantially planar, parallel outer surfaces 21*a*, each of which is formed collectively by outer surfaces of the movable segment 23. The main body segment 21 supports wheels 24 which are rotatably mounted in a bottom portion thereof. The wheels 24 have outer circumferential surfaces which allow the body member 20 to roll along an appropriate surface by virtue of the outer circumferential surface extending slightly beyond the bottom surface of the body member 20.

Figure 8:
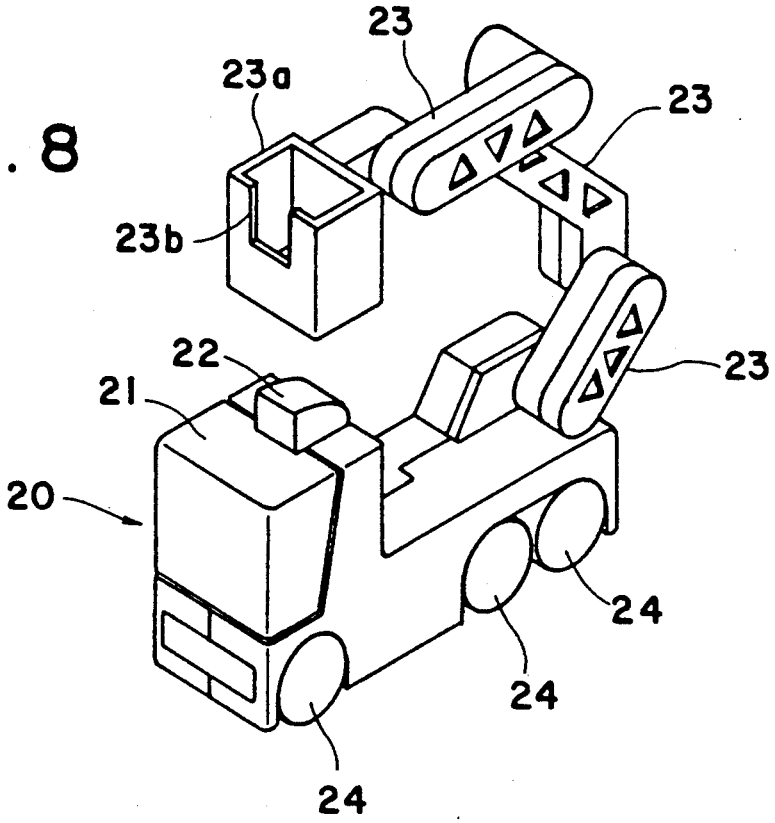
FIG. 8 is a perspective view of the fourth preferred embodiment of FIG. 7 transformed into a vehicle.
Figure 9:
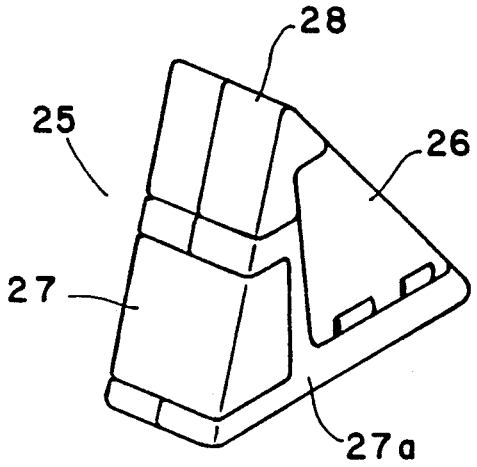
FIG. 9 is a perspective view of a fifth preferred embodiment of the present invention in a building block mode and having a geometric shape.

FIG. 8 illustrates the transformed building block now resembling a truck having a foldable arm which supports a bucket or gondola 23*a* at a distal end thereof. The movable segment 23 includes a plurality of pivotally connected sections which enable the movable segment 23 to be movable to infinite positions or folded in a retracted position as illustrated in FIG. 7, whereby outer surfaces of the movable segment 23 are substantially flush with outer surfaces of the body member 20. The bucket 23*a* has a cut-out portion 23*b* at a forward portion thereof which receives a pivotal projection 22 pivotally connected to the main body segment 21. In the retracted position illustrated in FIG. 7, the projection 22 is pivoted downwardly into the bucket 23*a* through the cut-out portion 23*d*. In the position illustrated in FIG. 7, an upper surface of the projection 22 is substantially flush with an upper surface of the body member 20. In the extended position illustrated in FIG. 8, the upper surface of the projection 22 becomes substantially perpendicular to the upper surface of the body member 20. Basically, the transformed vehicle is a fire truck in which the projection 22 is designed to resemble a warning light.

Similar to the embodiment of FIGS. 3 and 4, wheels 24 are provided in a bottom portion of the body member to facilitate rolling of the body member in either the non-transformed shape or the transformed shape. The wheels have outer circumferential surfaces which extends slightly beyond the bottom surface of the body member 20 so as not to detract substantially from the building block nature of the body member when it is in its retracted, geometrically-shaped disposition.

FIGS. 9–12 illustrate a fifth embodiment of the present invention, in which a building block 25 has a trihedron-shaped body. The trihedron-shaped body 25 has a main body segment 27 and a movable body segment 28. Opposite sides of the body 25 are substantially planar and parallel and have the shape of an equilateral triangle. The equilateral triangle is formed by coplanar outer surfaces of the two segments 27 and 28. Wings 26 are pivotally mounted on the opposite sides of the main body segment 27 such that in the retracted position illustrated in FIG. 9, outer surfaces of the wings 26 are flush with outer surfaces of the main body segment 27 and the movable body segment 28.

Figure 10:
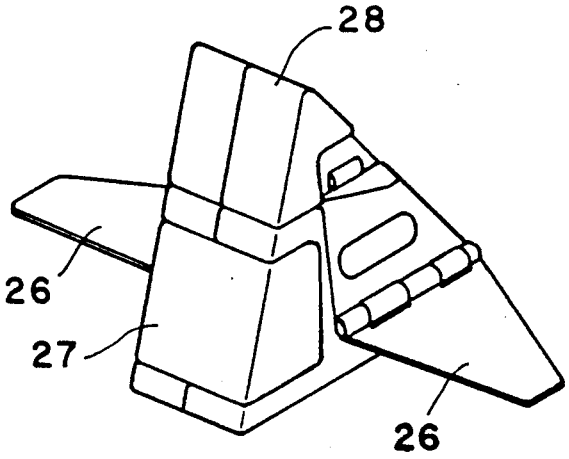
FIGS. 10 and 11 are perspective views showing steps for transforming the fifth preferred embodiment of FIG. 9 into a vehicle.

As illustrated in FIG. 10, the wings 26 pivot downwardly to a position which is substantially perpendicular to the outer surfaces 27*a* of the body member 25.

Figure 11:
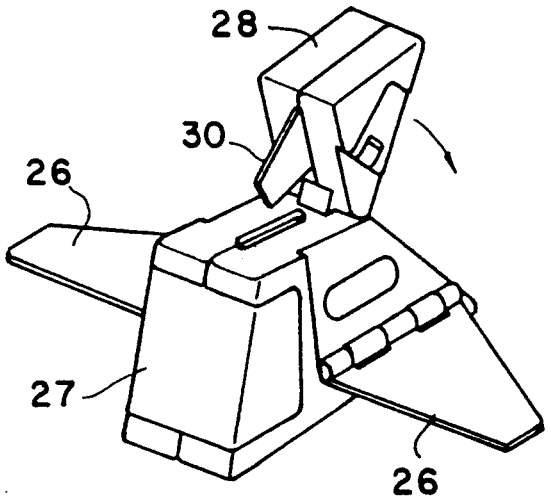
Figure 12:
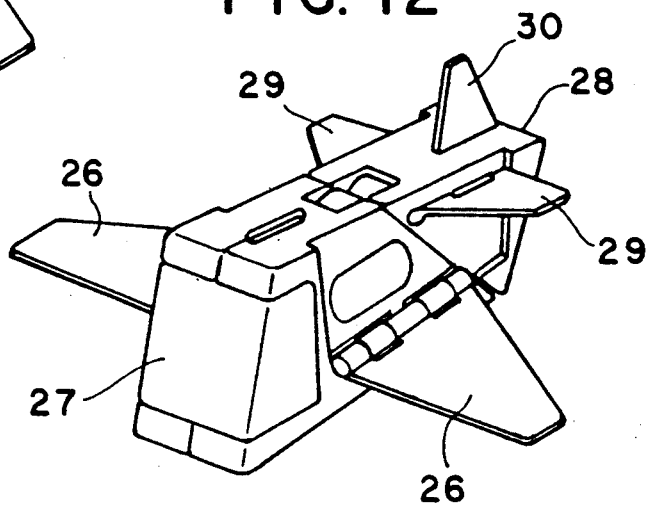
FIG. 12 is a perspective view of the fifth preferred embodiment of FIG. 9 transformed into a vehicle.
Figure 13:
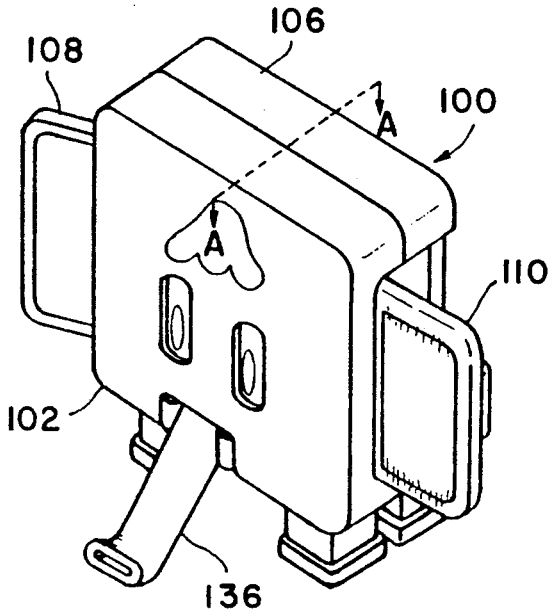
FIG. 13 is a perspective view of a sixth preferred embodiment of the present invention in an animal shape mode.

As illustrated in FIG. 11, the movable segment 28, after the wings 26 are pivoted downwardly, is pivoted rearwardly relative to the main body segment 27 until the bottom surface 28*a* of the movable segment 28 becomes substantially coplanar with an upper surface 27*b* of the main body segment 27 (see FIG. 12).

The pivotal movement of the movable segment 28 is facilitated by a link 31 which is pivotally connected to the main body segment 27 at one end and the movable body segment 28 at the other end. The link 31 is similar to that which is described with respect to the embodiment of FIGS. 3 and 4 and allows the movable segment 28 to pivot and slide into the extended position illustrated in FIG. 12. In the extended position, the two segments 27 and 28 form a fuselage of an airplane and thus is transformed into the shape of a vehicle.

The movable segment 28 includes a vertical tail 30 which extends outwardly from the bottom surface 28*a*. The vertical tail is receivable in a slot provided in the upper surface 27*b* of the main body portion 27 in the retracted position; in the extended position, the vertical tail extends upwardly at the tail portion of the fuselage. Horizontal tails 29 are pivotally connected to the movable segment 28 and pivot outwardly in the extended position illustrated in FIG. 12. In the retracted position, as illustrated in FIG. 11, the horizontal tails 29 are recessed into the movable segment 28.

Similar to the other embodiments, other features of an airplane may be formed in the outer surfaces of the body, such as, a windshield and passenger windows. Also, the bottom surface of the body 25 may be provided with wheels 32 which facilitate rolling of the body 25 along an appropriate surface. A noise making mechanism may be provided within the main body segment 27 such that when one of the wheels 32 rotates a clicking sound is generated similar to that which was described with respect to the embodiment of FIGS. 3 and 4. Similarly, the embodiment of FIGS. 7 and 8 may be provided with a noise making mechanism activated by rotation of one or more of the wheels 24. These noise making mechanisms are generally known and a further description is not necessary to achieve an understanding of the present invention.

The various embodiments described above may be utilized as building blocks by using the outer parallel surfaces thereof when each embodiment is in the retracted position. The building blocks may be transformed into vehicular toys such as an automobile, airplane, truck, etc., by moving at least one movable segment of a main body.

FIGS. 13–17 illustrate an embodiment of the present invention in which a substantially quadrahedron-shaped building block is transformable into an animal toy which resembles an elephant. The building block is generally referred to by the numeral 100. The block 100 has parallel, substantially rectangular opposite sides 102 and 104 which are spaced apart by a continuous sidewall 106 which extends around the building block 100.

A pair of ears 108 and 110 are pivotally mounted in the sidewall 106 on opposite sides of the block. In a retracted position, the ears 108 and 110 are recessed into the sidewall 106 and have outer surfaces which are flush with the outer surfaces of the sidewall. Thus, in the retracted position, the ears 108 and 110 form part of the quadrahedron shape of the building block 100. The ears 108 and 110 may be pivotally mounted by means of stub shafts 112 and 114 formed on the top and bottom of each ear, respectively, with the two stub shafts being coaxial and providing a verticle pivot axis. The stub shafts 112 and 114 are journalled in the interior of the block 100 by simply fitting into holes formed in the molded plastic block.

Figure 16:
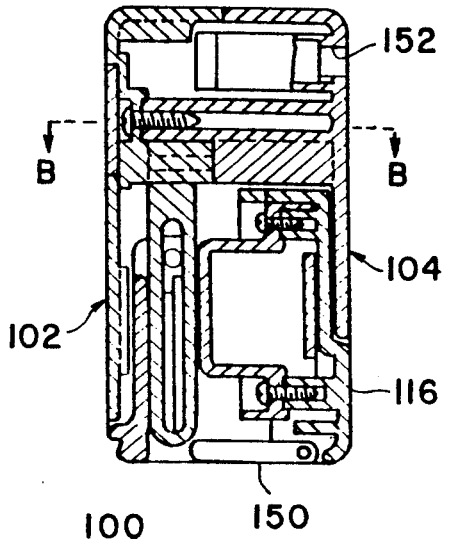
FIG. 16 is a cross sectional view taken substantially along line a—a of FIG. 13 in the retracted, building block mode.
Figure 14:
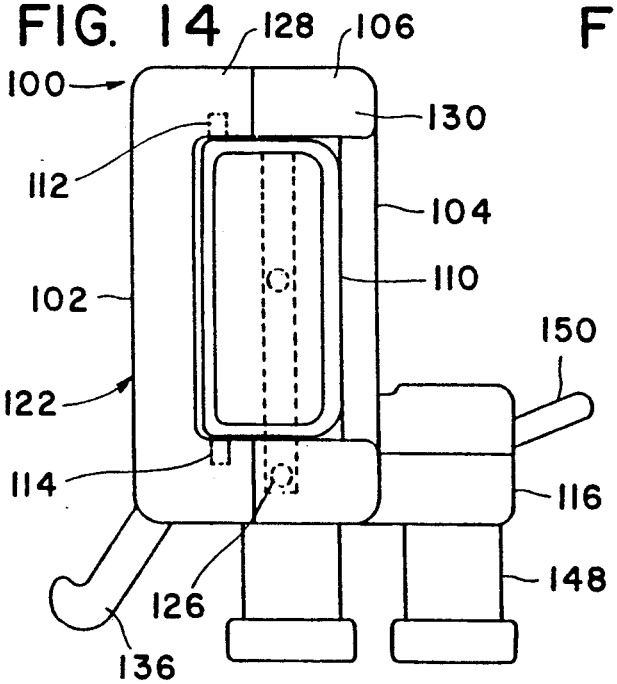
FIG. 14 is a side elevational view of the embodiment of FIG. 13.
Figure 15:
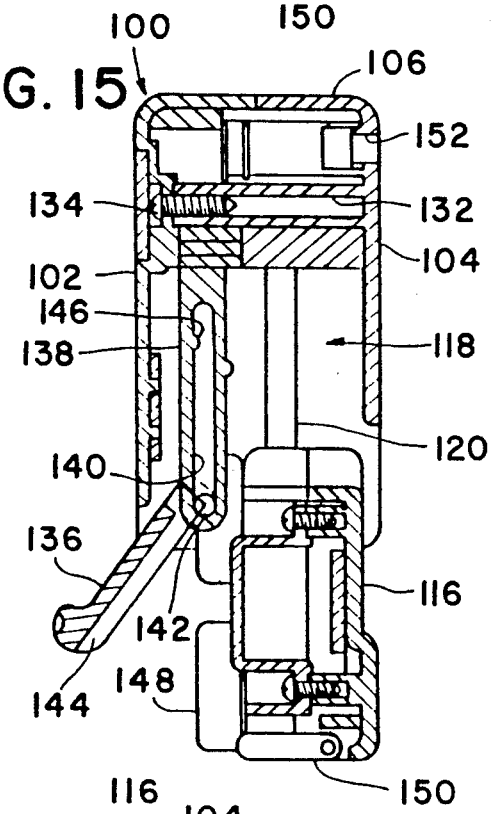
FIG. 15 is a cross sectional view of the embodiment of FIG. 13, taken along line a—a, with a portion of the body and legs folded for retraction into a head portion.
Figure 17:
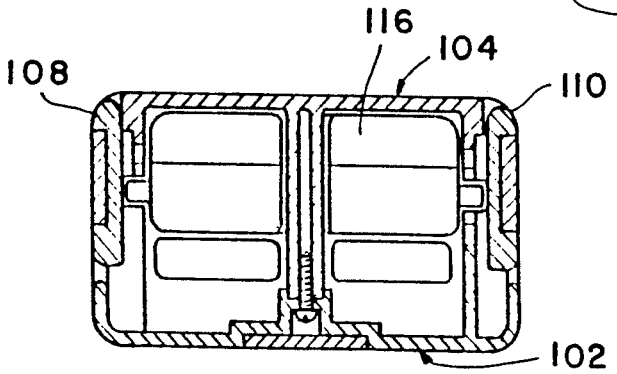
FIG. 17 is a cross sectional view taken along line b—b in FIG. 16.

As shown in FIGS. 14 and 15, a torso 116 is retractable from a cavity 118 provided in the interior of the block 100. The torso 116, shown in the retracted position in FIG. 16, is at first translated downwardly from within the block 100 by sliding along grooves 120 provided in opposite sides of the inner wall of the head portion 122 of the block 100. Pin 126 formed on opposite sides of the torso 116 slide within the grooves 120 to guide and slidably support the torso 116 in its downward movement from within the head portion 122. Once reaching the position shown in FIG. 15, the torso 116 is then pivoted about an axis defined between the two opposite side pins 126 until the torso achieves a substantially orthogonal disposition relative to the head portion, as shown in FIG. 14.

The head portion 122 is formed by two shell halves 128 and 130, with an animal face and facial features being formed on or in surface 122 of shell half 128. The two halves are held together by an internal stud 132 and screw 134.

A trunk 136 is retractable into and out of the block 100, either before or after retraction of the torso portion 116, by means of a sliding pivotal connection with a support arm 138 which includes an elongated slot 140. A pivot pin 142 formed on a proximal end of the trunk 136 fits into the slot 140 and moves axially along the slot when retracting the trunk 136 from the block 100. In the fully downward position shown in FIG. 15, the pin 142 pivots in the slot 140 so that the trunk 136 angles slightly forwardly. A rear portion of the trunk 136 is provided with a groove 144 so that when retracted upwardly into the block 100, the trunk 136 intermeshes with the support arm 138 so as to save space. When in the fully upward position, the trunk 136 is held in place by a detent 146 which catches the pivot pin 142, thereby providing resistance to downward movement which can be overcome by exerting sufficient force.

Four legs 148 are retractable outwardly from the torso 116 after the torso has pivoted to its orthogonal disposition. These legs provide a base for supporting the block 100, now transformed into an animal toy, in a standing position. A rearward portion of the torso 116 is provided with a tail 150 which pivots into and out of the torso.

A whistle 152 is formed in an upper portion of the block 100. The whistle 152 includes a hole formed in a rearward upper portion of the block so that, by blowing in the hole, an animal-like sound can be made.

As is apparent from FIGS. 13–17, when all of the appendages are retracted into the block 100, the block is appropriate for playing a game of building blocks. When the various body parts are moved out of the block, the block is transformed into an animal toy.

Figure 18:
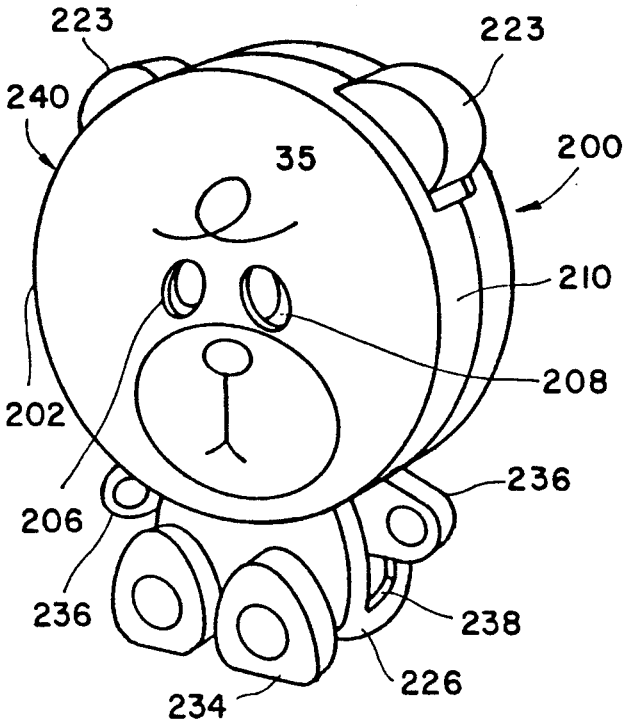
FIG. 18 is a perspective view of a seventh preferred embodiment of the present invention in an animal shape mode.
Figure 19:
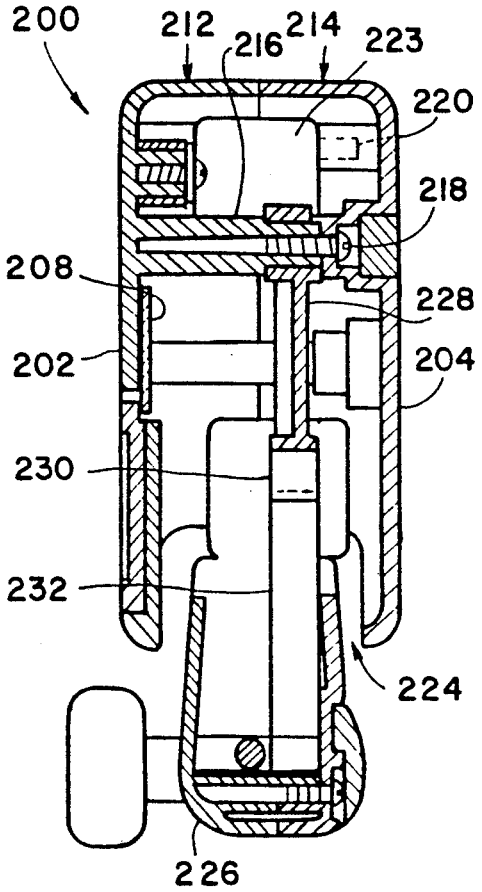
FIG. 19 is a cross sectional view of the embodiment of FIG. 18.
Figure 20:
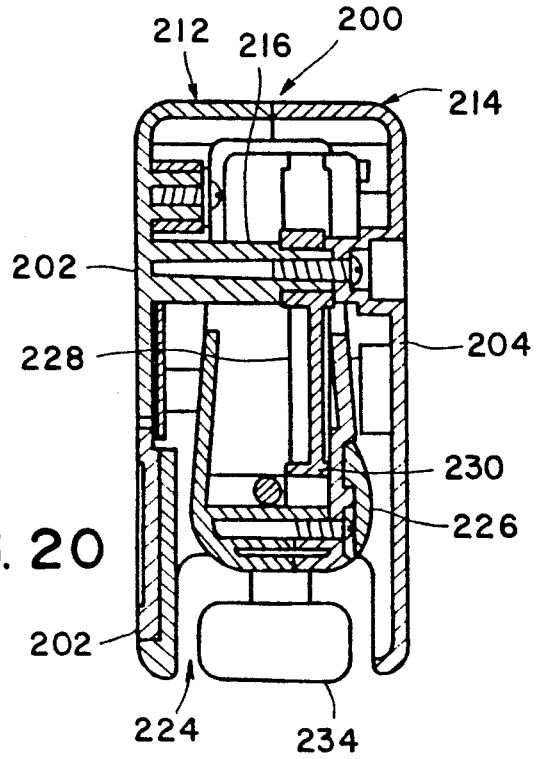
FIG. 20 is a cross sectional view similar to FIG. 9, with body segments retracted into a building block mode.

The embodiment of FIGS. 18–20 is a building block 200 which has a cylindrical shape prior to transformation into an animal toy. The animal toy is intended to resemble a bear. The block 200 is cylindrical in shape and has two parallel, opposed circular surfaces 202 and 204. Surface 202 is provided with the facial features of a bear. Moreover, a pair of eye holes 206 are formed thereon. An eye plate 208 is pivotally mounted behind the eye holes 206 so as to freely move and give the appearance of eye movement.

The two circular surfaces 202 and 204 are spaced apart by an annular sidewall 210. Similar to the previous embodiment, the block 200 is formed by a pair of molded plastic shell halves 212 and 214. The two shell halves are held together by a stud 216 and screw 218. Again, similar to the previous embodiment, a whistle 220 is formed in an upper portion of the block 200.

A pair of ears 223 are pivotally mounted within the block 200 so as to rotate between retracted and unretracted positions. In the retracted position, a surface of each ear conforms in shape to the annular sidewall 210 to provide a continuous sidewall. By rotating each ear 180°, to the position shown in FIG. 18, the block 200 takes on the appearance of a bear having ears.

A lower end of the block 200 is provided with an opening 224 from which a torso 226 is removable. The torso 226 is mounted on a support arm 228 which is pivotally mounted on the stud 216. The support arm 228 is provided with a headed portion 230 which is received in a central passageway 232 of the torso 226 so as to support the torso 226 in its upward and downward movement into and out of the block 200 through the opening 224. In the fully retracted position shown in FIG. 20, feet 234 which are pivotally connected to the torso 226 are pivoted in-line with the torso 226 so that the feet 234 can be received in the opening 224. The lower surfaces of the feet 234 are substantially flush with the annular sidewall 210 when the feet are retracted into the body.

A pair of arms 234 are pivotally mounted in the torso 226 and swing in and out of openings 238 provided on opposite sides of the torso 226. Thus, after moving the torso 226 downwardly out of the opening 224, arms 236 are pivoted outwardly to give the appearance of arms for the bear.

Due to the pivotal connection of the support arm 228 to the stud 216, the head portion 240 is capable of swinging back and forth relative to the torso when the torso is removed from the head portion.

Figure 21:
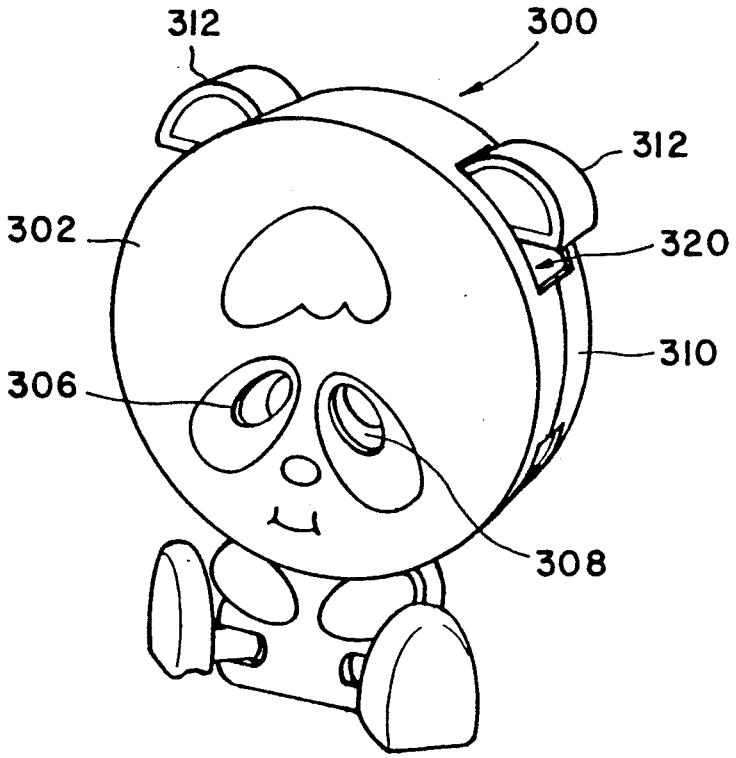
FIG. 21 is a perspective view of an eighth preferred embodiment of the present invention.
Figure 22:
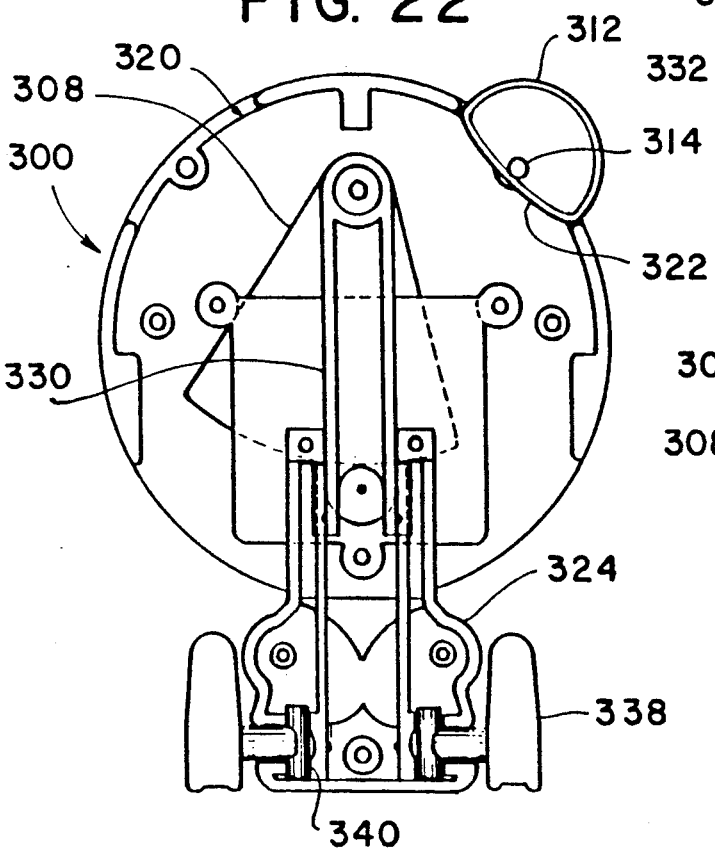
FIG. 22 is a cross sectional view of the embodiment of FIG. 21.
Figure 23:
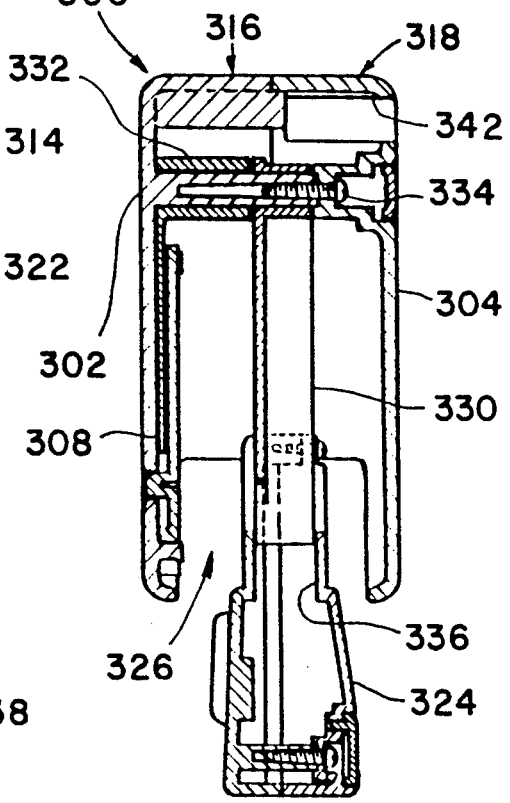
FIG. 23 is a cross sectional view similar to FIG. 22, in the retracted position.

FIGS. 21–23 represent another embodiment of the present invention which is similar to the embodiment of FIGS. 18–20. The building block 300 is transformable into another bear toy. However, the bear of FIGS. 21–23 is intended to resemble a panda bear. The block includes two circular parallel opposed surfaces 302 and 304, the surface 302 being provided with the facial features of a panda bear. Similar to the other embodiments, a pair of eye openings 306 are provided in the surface 302, behind which an eye plate 308 is pivotally mounted.

The opposite circular surfaces 302 and 304 are spaced apart by an annular sidewall 310, in which a pair of ears 312 are mounted. Each ear 312 is provided with a pivot pin 314 which is mounted between the two shell halves 316 and 318, which form the head portion of the bear toy. A pair of openings 320 are formed in the annular sidewall 310 to facilitate movement of the ears 312 between retracted and unretracted positions. In the retracted position, the ears protrude from the annular sidewall 310, while in the unretracted position, the ears are rotated into the head portion such that a surface 322 of the ears is flush with the annular sidewall 310.

A torso 324 is retractable into and out of the head portion through an opening 326 provided in a lower end of the head portion. In the retracted position, the bottom of the torso 324 is substantially flush with the annular sidewall. A support arm 330 is pivotally connected to a stud 332. Similar to other embodiments, the stud 332 is used in conjunction with a screw 334 to hold the two shell halves 316 and 318 together. The torso 324 slides along the support arm 330 by means of a central opening 336 provided in the torso 324. A detent is provided in either the distal end of the support arm 330 or the upper end of the torso central opening 336 so as to lock the head portion and torso in the position shown in FIG. 23. Once in this extended or unretracted position, the head portion can pivot relative to the torso 324 by means of the pivotal connection of the support arm 330 to the stud 332.

A pair of legs 338 are pivotally mounted in the torso 324 in a lower portion thereof by means of shafts 340 which are journaled in the torso 324. The shafts 340 provide vertical pivot axes to enable the legs 338 to pivot substantially 90° from the sides of the torso to the front of the torso. In order to retract the torso into the body, the legs must be pivoted to the opposite sides of the torso.

Similar to the other embodiments, a whistle 342 is provided in an upper portion of the head portion of the block 300.

Referring now to FIGS. 24–27, a trihedron-shaped building block is generally referred to by the numeral 400. The block 400 includes a pair of parallel, opposed triangularly shaped surfaces 402 and 404, and a continuous sidewall 406 formed at substantially a right angle to the two triangularly shaped surfaces 402 and 404. Facial features of a rabbit are formed on the surface 402, and a pair of eye holes 408 are formed in a similar manner to the other embodiments. An eye plate 410 is pivotally mounted behind the eye holes 408 so as to give the appearance of eye movement when the plate pivots back and forth. A tongue 412 is slidably mounted beneath the eye plate, and is freely movable when the block 400 is moved or shaken.

Similar to the other embodiments, a head portion is formed by a pair of shell halves 416 and 418, which are assembled together by a stud 420 and screw 422. A pair of recesses 414 are provided on converging surfaces of the sidewall 406 so as to receive pivotally mounted ears 424. Each ear 424 is provided with a pivot pin 426 which is received in the head portion between the two shell halves 416 and 418. In the retracted position, the ears 424 are mounted flush with the sidewall 406.

Figure 24:
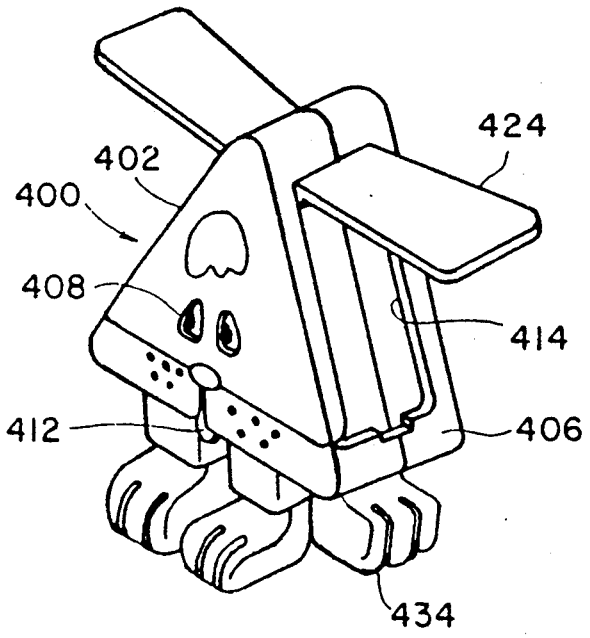
FIG. 24 is a perspective view of a ninth preferred embodiment of the present invention.
Figure 25:
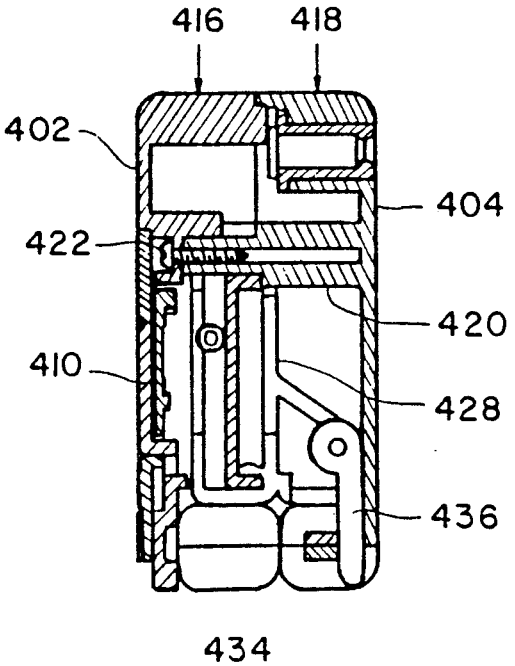
FIG. 25 is a cross-sectional view of the embodiment of FIG. 24.
Figure 26:
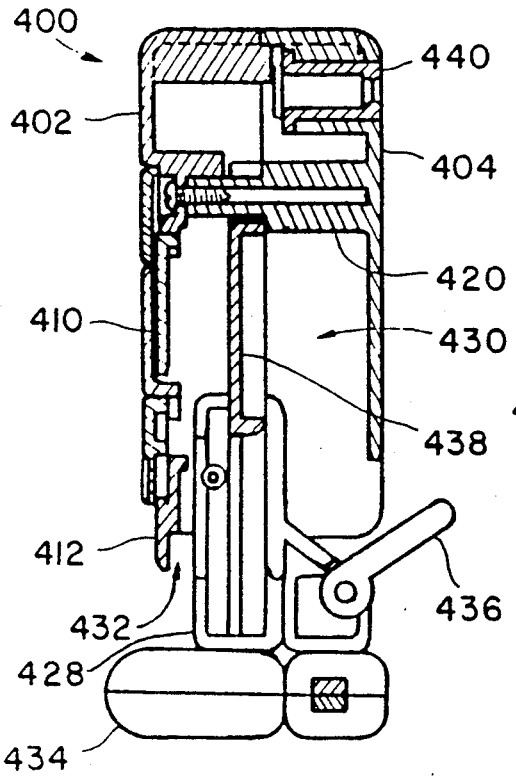
FIG. 26 is a cross-sectional view of the embodiment of FIG. 24, with portions thereof extended.
Figure 27:
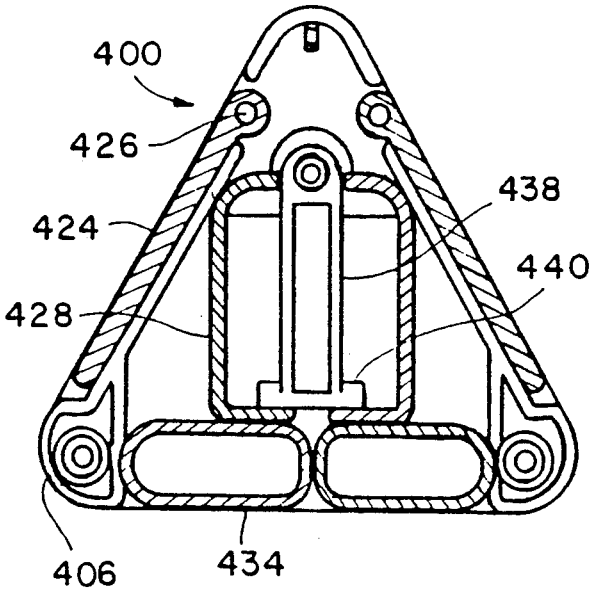
FIG. 27 is a cross-sectional view of the embodiment of FIG. 24, turned 90° from the cross-section of FIG. 25.
Figure 28:
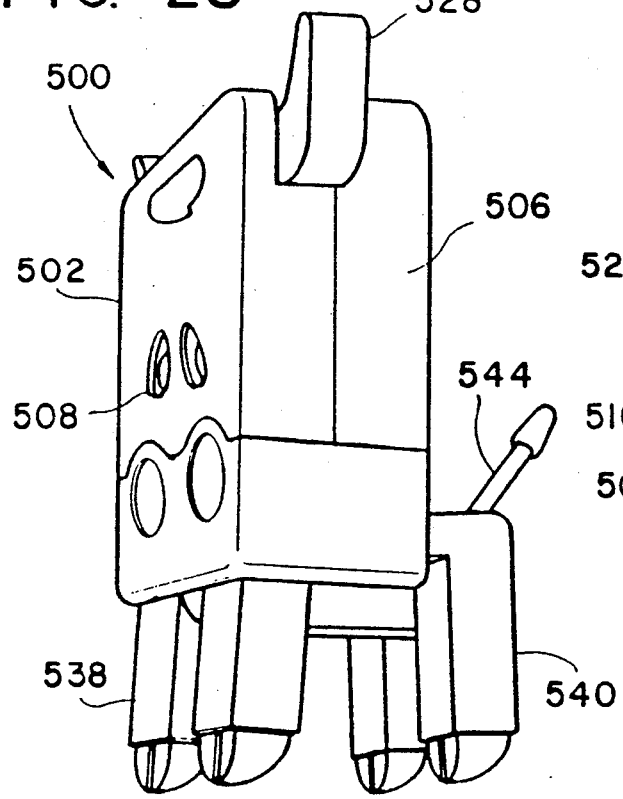
FIG. 28 is a perspective view of a tenth embodiment of the present invention.
Figure 29:
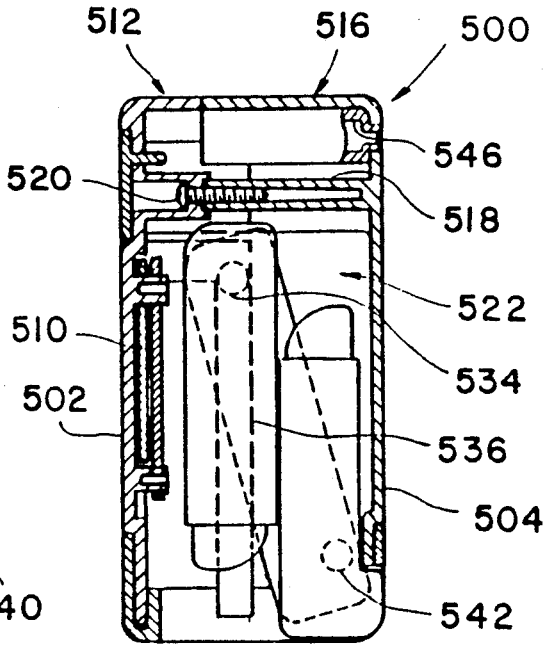
FIG. 29 is a cross-sectional view of the embodiment of FIG. 28.
Figure 30:
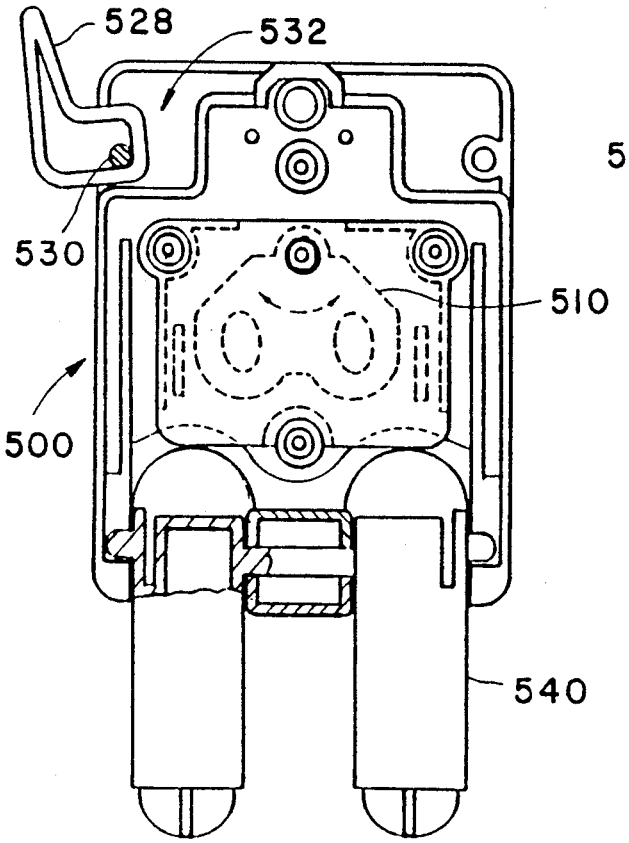
FIG. 30 is an elevational view, partially cut away, of the embodiment of FIG. 28.
Figure 31:
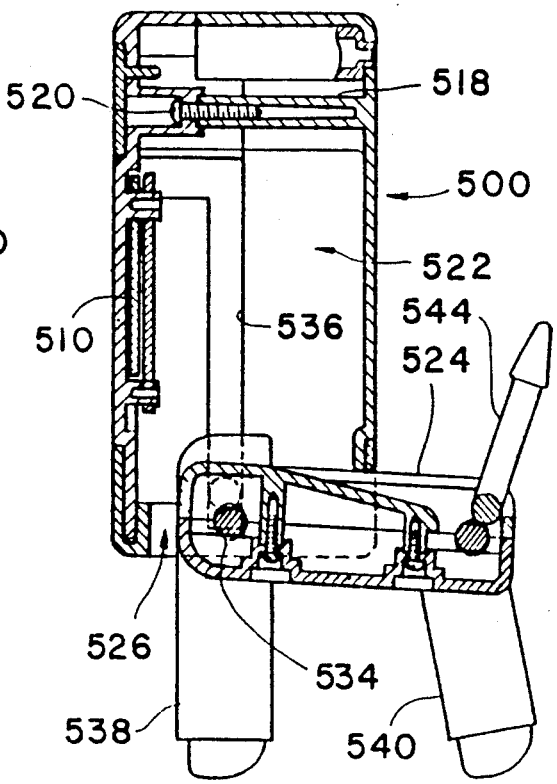
FIG. 31 is a cross-sectional view of the embodiment of FIG. 28 in an extended position.
Figure 32:
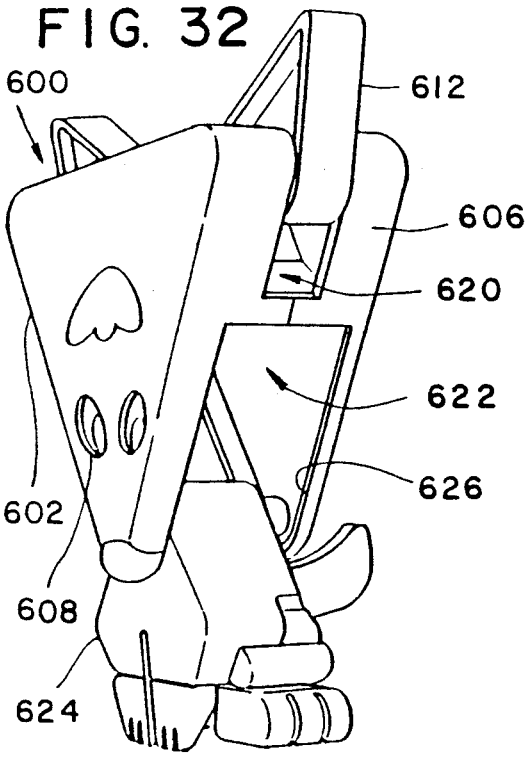
FIG. 32 is a side elevational view of an eleventh embodiment of the present invention.

A torso 428 is received in the head portion by sliding into a cavity 430 of the head portion through an opening 432. The torso 428 has four feet 434 connected thereto, with at least two of the feet being pivotally connected therein. Preferably, the front two feet are pivotally mounted so as to pivot to a forward orientation as shown in FIGS. 24 and 27. In FIGS. 25 and 28, the feet are pivoted to the side so as to allow the torso 428 to slide upwardly into the head portion. When in the fully retracted position of FIGS. 25 and 28, the bottom of the feet are substantially flush with the sidewall 406. A rearward portion of the torso 428 is provided with a pivotally mounted tail 436 which can be pivoted outwarded as shown in FIG. 27 when the building block is transformed into its rabbit shape.

A support arm 438 is pivotally connected to the stud 420 at one end, and slidably received in the torso 428 so as to facilitate sliding of the torso along the arm 438. A distal end 440 of the support arm 438 is headed so as to keep the torso 428 and the support arm 438 from separating when in the fully extended position. Also, when in the fully extended position, the torso 428 and the support arm 438 are capable of relative pivotal movement o that the head portion can tilt back and forth about a longitudinal axis of the headed distal end 440. Since the pivot axis at the distal end 440 is perpendicular to the pivot axis of the support arm 438 at the stud 422, the head portion is capable of swiveling relative to the torso, i.e., simultaneous fore and aft and side to side movement.

Similar to the other embodiments, a whistle 440 is provided in an upper portion of the head portion, and has a tone designed dto emulate an animal sound.

The embodiment of FIGS. 29–32 is a quadrahedron shaped building block 500 which is transformable into a bovine animal toy. The building block 500 includes a pair of parallel, opposed substantially rectangular surfaces 502 and 504, and a continuous sidewall 506 disposed between the surfaces 502 and 504. Facial features of a bovine animal are included on the surface 502, along with eye holes 508. An eye plate 510 is pivotally mounted behind the eye holes 508 so as to give the appearance of eye movement when the building block 500 is moved during play.

A head portion is formed substantially by two shell halves 512 and 516 which are held together by a stud 518 and screw 520. The head portion is hollow and includes an interior chamber 522 into which a torso 524 is retractable by passing through an opening 526 disposed at the bottom of the head portion.

A pair of horns 528 are pivotally mounted on opposite side portions of the block 500. Each horn is provided with a pivot pin 530 which facilitates pivotal movement of the horn 528 into and out of a recess 532. In the retracted position, the horns 528 conform to the shape of the sidewall 506 to be flush therewith.

The torso is provided with pivot pins 534 which are received in slots 536 formed in the head portion on opposite sides thereof. In the retracted position illustrated in FIG. 30, the pivot pin 534 is received in the uppermost part of the slot 536. Front legs 538 and rear legs 540 are pivoted about pivot pins 534 and 542, respectively, to fit into the chamber 522. When the torso 524 has been removed from the chamber 522, it is pivoted about pivot pin 534 substantially 90° to the disposition illustrated in FIG. 32. Then, the legs are pivoted to a vertical position so as to support the animal toy in a standing position. In the extended or deployed position illustrated in FIG. 32, a tail 544 is pivotal upwardly from the torso 524. In the retracted position illustrated in FIG. 30, a lower and rearward surface of the torso 524 conforms to the shape of the sidewall 506 and a portion of the surface 504. This is to ensure that in the building block mode, the device can stand on any side with relative stability. This feature is also provided for all of the previous embodiments and enhances the utility of each device as a building block. Moreover, as is the case with the other embodiments, a whistle 546 is provided in an upper portion of the head portion to emulate animal sounds.

Referring now to the embodiment of FIGS. 33–36, a trihedron shaped building block is generally referred to by the numeral 600. The block 600 is transformable from a trihedron shaped block to an animal toy, with the animal resembling a wolf or dog. The block 600 includes a pair of parallel, opposed substantially triangular shaped surfaces 602 and 604, which are spaced apart by a continuous sidewall 606. The surface 602 is provided with facial features, including a pair of eye holes 608 and a pivotally mounted eye plate 610.

A pair of ears 612 are pivotally mounted in opposite sides of the block 600 between shell halves 614 and 616 which define the head portion of the animal toy. Each ear 612 is provided with a pivot pin 614 which is used to pivotally mount the ear between the shell halves 614 and 616 by fitting into corresponding portions of the shell halves. When the ears 612 are retracted, sides 616 and 618 become flush with the sidewall 606 while the ears are recessed into corresponding openings 620.

The two shell halves 614 and 616 define a hollow chamber 622 into which a torso 624 is fitted. The torso 624 is pivotally mounted at the opening 626 provided in the sidewall 606. A stud 628 and screw 630, which are used to assemble the two shell halves 614 and 616 also facilitates the pivotal connection of the torso 624 by providing a bearing surface upon which the torso is pivotally mounted.

The torso 624 is provided with converging sides 632 and 634 which are angled at the same degree as the sidewall 606 at sides 636 and 638, so that when the torso 624 is rotated into the chamber 622 in the retracted position, the sides 632 and 634 become substantially coplanar with the side 636 and 638.

Figure 33:
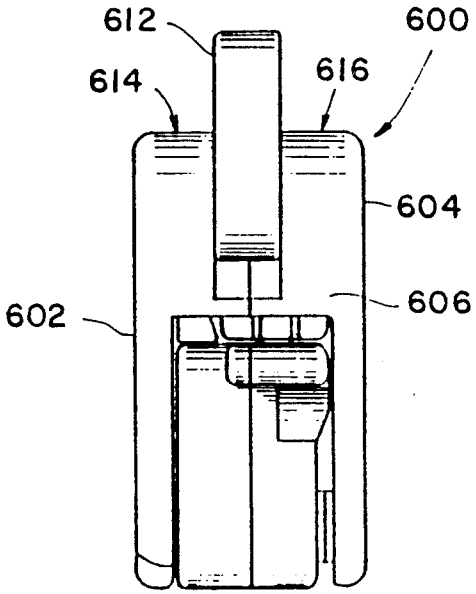
FIG. 33 is an end view of the embodiment of FIG. 32.
Figure 34:
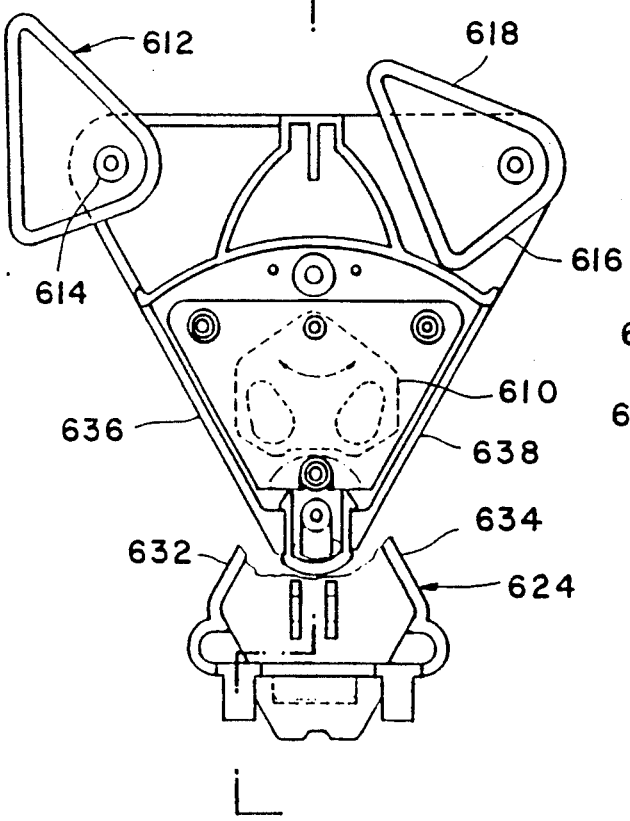
FIG. 34 is an elevational view, of one half of the body of the embodiment of FIG. 32.
Figure 35:
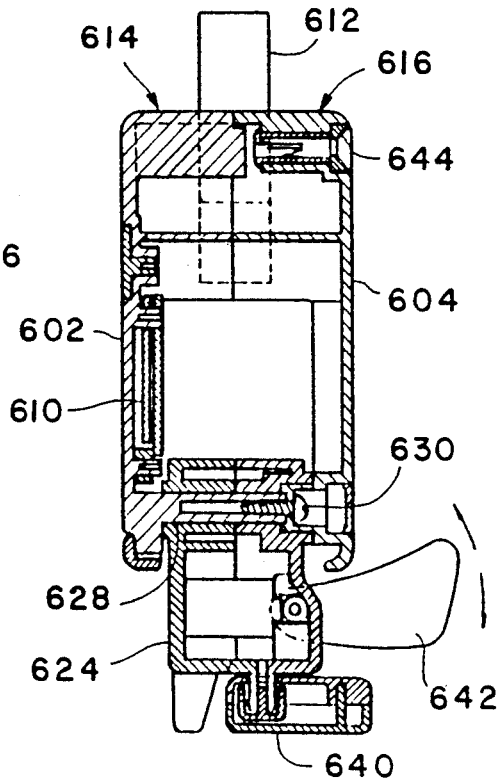
FIG. 35 is a cross-sectional view of the embodiment of FIG. 32.
Figure 36:
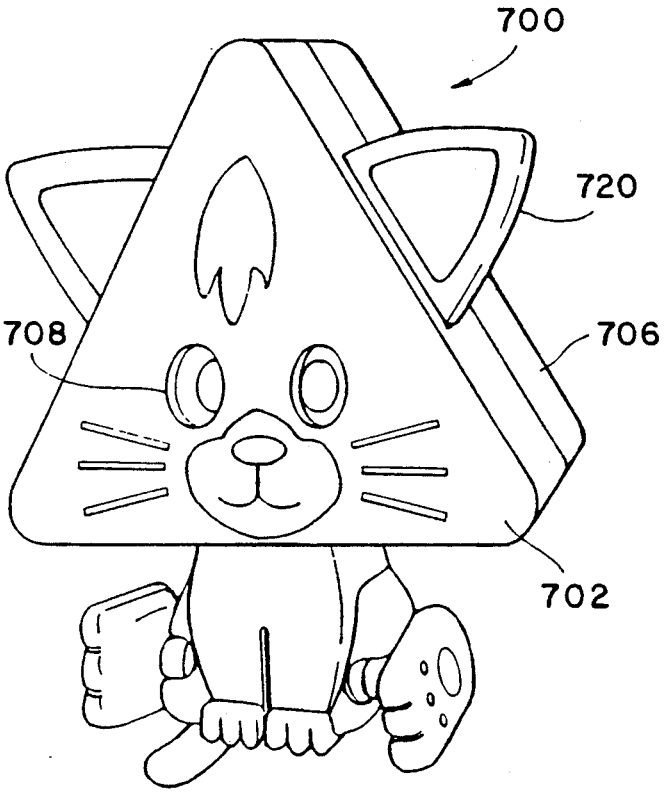
FIG. 36 is a perspective view of a twelfth embodiment of the present invention.
Figure 37:
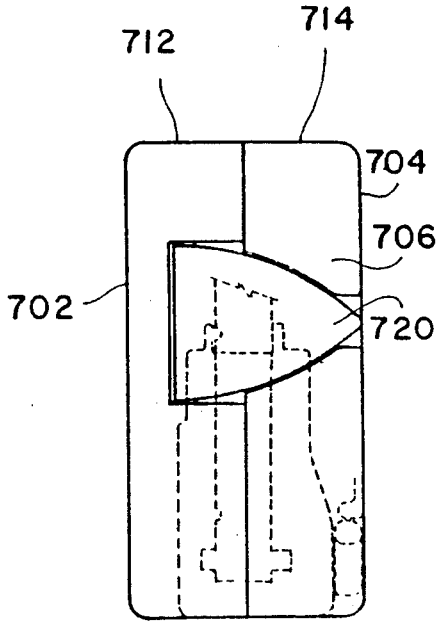
FIG. 37 is an end view of the embodiment of FIG. 36.

Similar to the other embodiments, the animal toy of FIGS. 33–36 includes pivotally mounted feet 640 which rotate to the position of FIG. 36 as a deployed position, while in the retracted position the legs are pivoted outwardly to the position shown in FIG. 33. Also, a tail 642 is pivotally mounted in the torso 624 to pivot substantially 90° downwardly when transforming the building block into an animal toy. Also, a whistle 644 is provided in an upper portion of the head portion, similar to the other embodiments.

Referring to the embodiment of FIGS. 37–40, a trihedron-shaped building block is generally referred to by the numeral 700. The block includes two parallel, opposed triangularly shaped surfaces 702 and 704 which are spaced apart by a continuous sidewall 706. Surface 702 is provided with facial features which, as in the other embodiments, are flush with the surface 702, so as to maintain the substantially flat nature of the surface. The facial features of the embodiment of FIGS. 37–40 are intended to make the block resemble a cat when various movable members are deployed. A pair of eye holes 708 are formed in the surface 702, while an eye plate 710 is mounted behind the eye holes 708 in the block 700.

A pair of shell halves 712 and 714 form a head portion of the animal toy. The two shell halves are held together by a stud 716 and screw 718.

Figure 38:
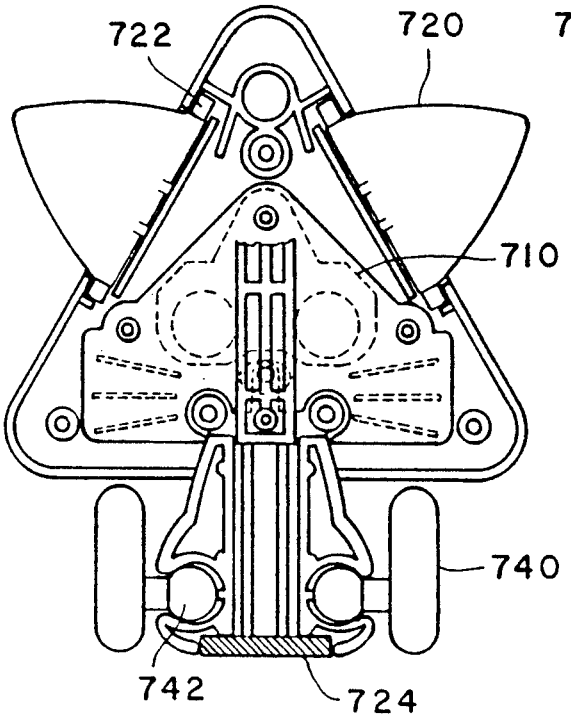
FIG. 38 is an elevational view showing one half of the body of the embodiment of FIG. 36.
Figure 39:
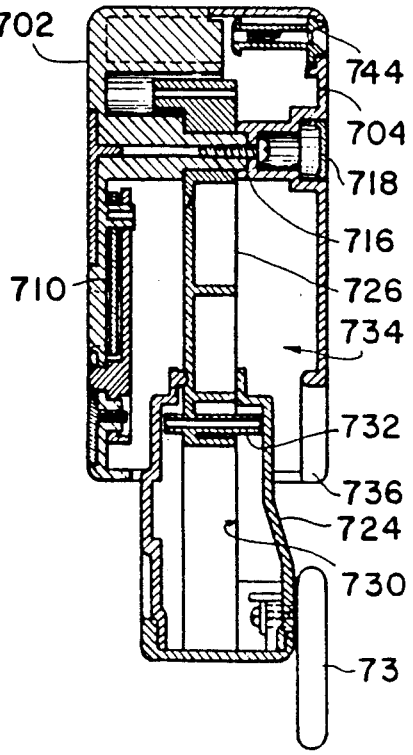
FIG. 39 is a cross-sectional view of the embodiment of FIG. 36.
Figure 41:
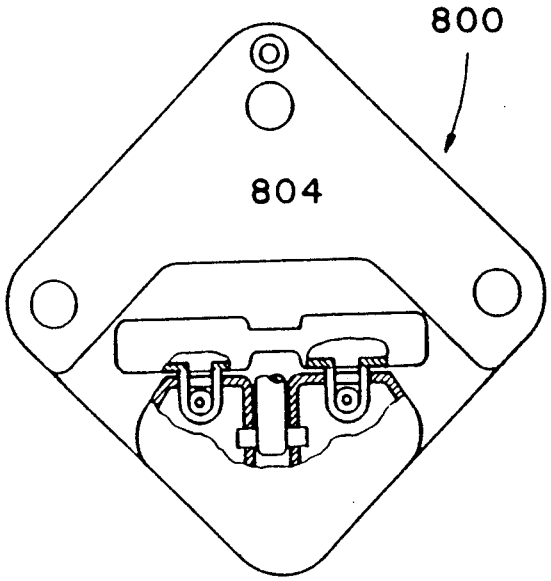
FIG. 41 is a side elevational view, partially cut away, of the embodiment of FIG. 40.
Figure 40:
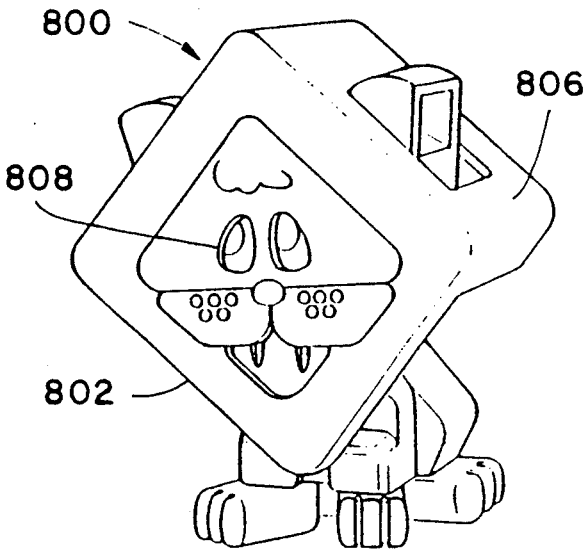
FIG. 40 is a perspective view of a thirteenth embodiment of the present invention.
Figure 42:
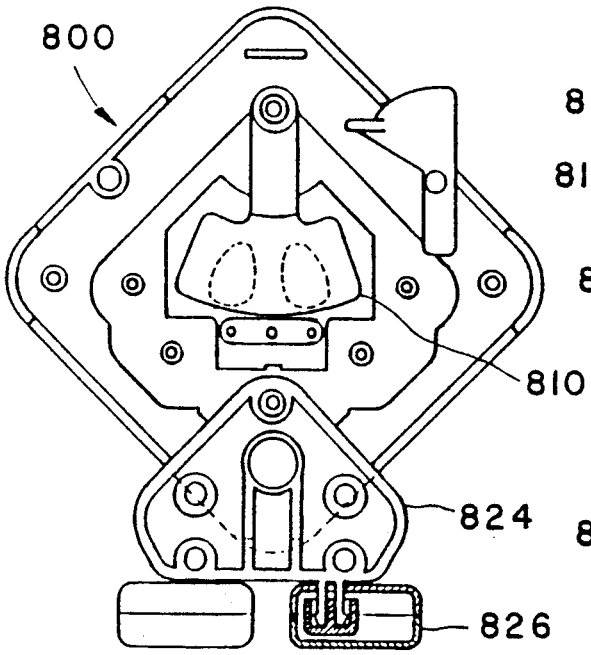
FIG. 42 is an elevational view of one half of the body of the embodiment of FIG. 40.
Figure 43:
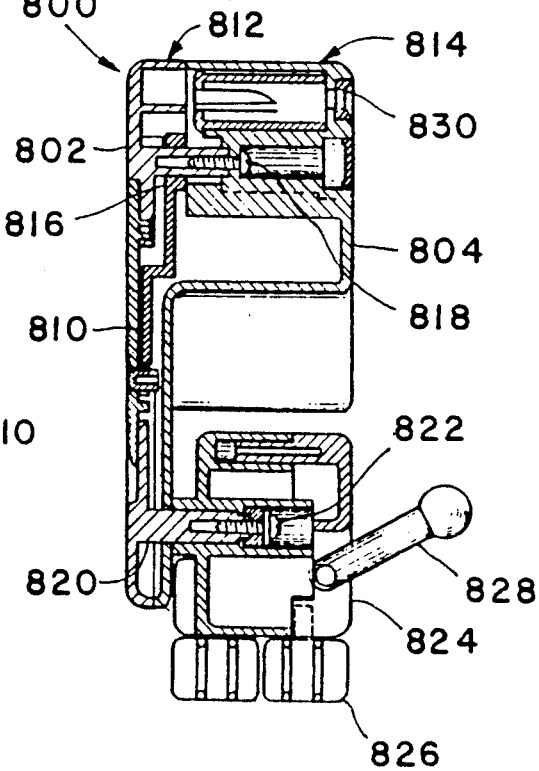
FIG. 43 is a cross-sectional view of the embodiment of FIG. 40.
Figure 45:
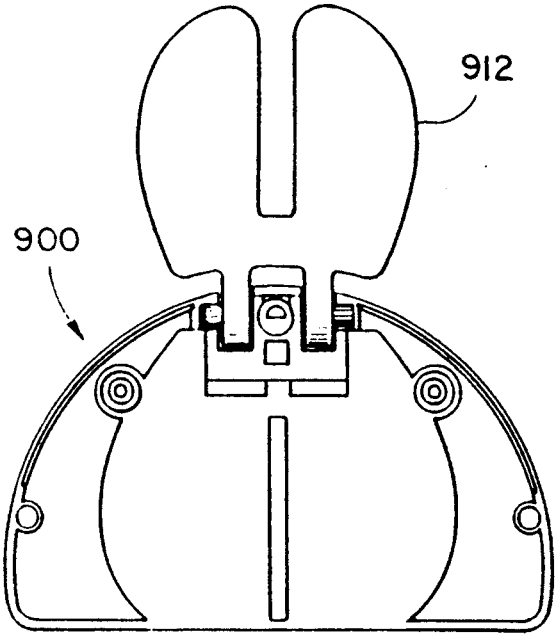
FIG. 45 is an elevational view showing one half of a body portion of the embodiment of FIG. 44.
Figure 44:
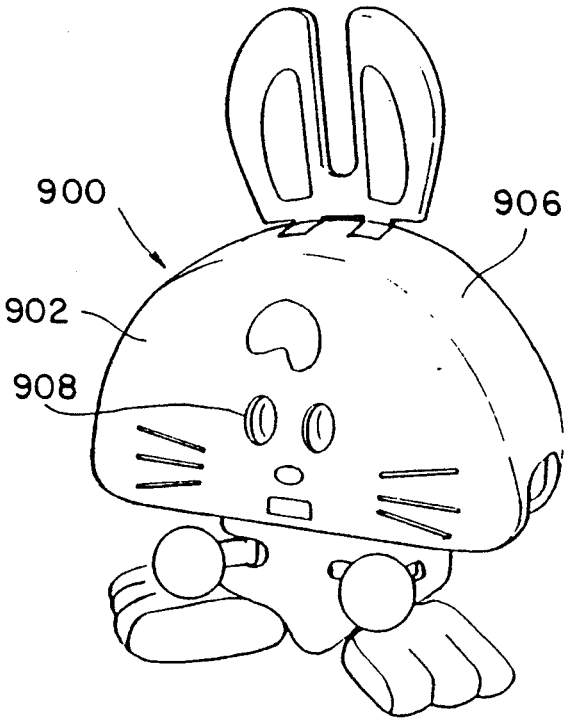
FIG. 44 is a perspective view of a fourteenth embodiment of the present invention.
Figure 46:
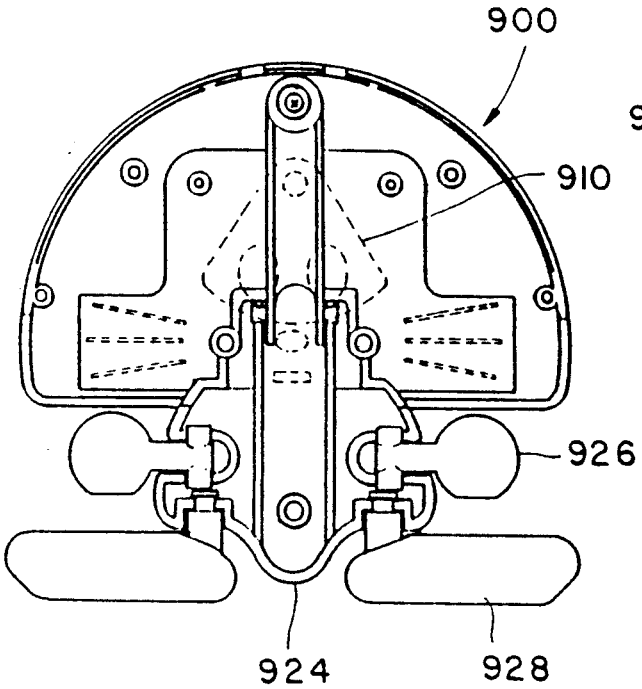
FIG. 46 is an elevational view of the embodiment of FIG. 44.
Figure 47:
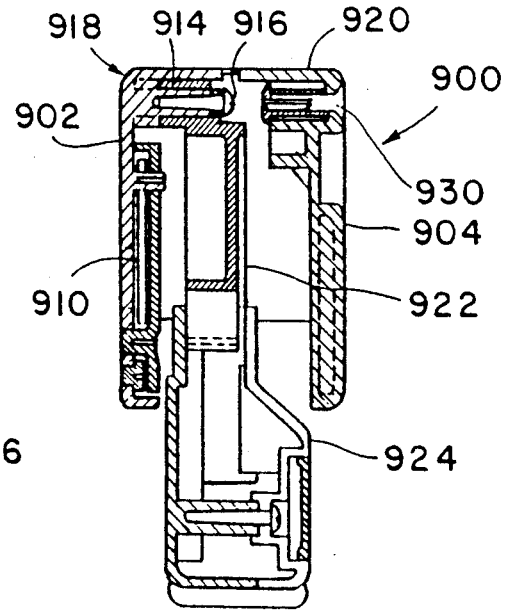
FIG. 47 is a cross-sectional view of the embodiment of FIG. 44.

A pair of ears 720 are pivotally mounted by pivot pins 722 so that the ears 720 can be received in recesses formed in the sidewall 706, as shown in FIG. 38.

A torso 724 is mounted on a support arm 726. The support arm 726 is pivotally connected to the head portion at the stud 716. The torso 724 is slidable along the support arm 726 by slidably receiving the support arm in a central passageway 730. A distal end 732 of the support arm 726 is headed to allow slight pivotal movement between the distal end of the support arm and the torso 724. This connection provides additional head movement which enhances the animal-like features of the toy after transformation from a building block mode.

The torso is also provided with a pivotally connected tail 733 which deploys after the torso 724 is removed from an interior chamber 734 of the head portion.

The tail 733 fits into a space 736 provided in surface 704.

The torso 724 also includes a pair of legs 740 which are connected by ball joints 742 to provide both pivotal and rotational movement. Moreover, as with the other embodiments, a whistle 744 is provided in an upper portion of the head portion of the animal toy.

The embodiment of FIGS. 41–44 is similar to the embodiment of FIGS. 33–36, in that the torso is pivotally mounted in the main body portion. The building block is generally referred to by the numeral 800 and includes a pair of flat, opposed substantial rectangular surfaces 802 and 804. Surface 802 is provided with facial features to resemble a lion. The opposite surfaces 802 and 804 are spaced apart by a continuous sidewall 806.

A pair of eye holes 808 are formed in the surface 802 and, as is the case for the other embodiments, an eye plate 810 is pivotally mounted behind the eye holes.

A pair of shell halves 812 and 814 form a head portion of the animal toy. The two shell halves are held together by a stud 816 and a screw 818. An additional stud 820 and screw 822 are used to pivotally mount a torso 824 to the head portion. The torso 824 is rotatable between retracted and deployed positions, with the retracted position shown in FIG. 42 and the deployed position shown in FIGS. 42, 43 and 44.

At least a pair of legs 826 are pivotally connected to the torso 824, along with a tail 828. A whistle 830 is provided in an upper portion of the head portion.

Referring to the embodiment of FIGS. 45–48, a building block is generally referred to by the numeral 900. The block 900 is transformable from a substantially semi-cylindrical shape to resemble a rabbit. The block 900 includes two parallel opposed semi-circular surfaces 902 and 904, with a sidewall extending therebetween. Surface 902 is provided with facial features including a pair of eye holes 908 behind which an eye plate 910 is pivotally mounted.

A pair of ears 912 are pivotally mounted in the head portion so as to extend upwardly in a deployed position, or conform to the surface 904 in the retracted position.

A stud 914 and screw 916 are used to hold two shell halves 918 and 920 together. A support arm 922 is pivotally connected to the stud 914 and slidably supports a torso 924. The torso 924 is provided with pivotally connected arms 926 and legs 928. A whistle 930 is provided in an upper portion of the head portion as in the other embodiments.

The many features and advantages of the present invention are apparent from the detailed specification, and thus, it is intended by the appended claims to cover all such features and advantages of the transformable block toys which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to falling within the scope and the spirit of the invention.

What is claimed is:

1. A transformable block toy comprising:

a first body segment; and a second body segment movably connected to the first body segment and being movable between a first, transformed position and second, untransformed position;

the first body segment and the second body segment collectively having a first geometric shape when the second body segment is in the first, transformed position and second geometric shape when the second body segment is in the second, untransformed position;

wherein the second body segment is a wedge having two substantially planar, parallel, triangularly-shaped outer surfaces spaced apart by three contiguous side surfaces, wherein one of the side surfaces has a recess in which a rotatable member is mounted, and an adjacent one of the side surfaces has a recess in which a pivotal member is mounted adjacent the rotatable member; and wherein the rotatable member has two opposite side surfaces, one of which has a projection extending outwardly therefrom which is receivable in the corresponding recess of the side surface.

2. A transformable block toy according to claim 1, wherein the first and second body segments are pivotally interconnected.

3. A transformable block toy according to claim 2, wherein the first and second body segments are rotatable 180° relative to each other.

4. A transformable block toy according to claim 3, wherein the first body segment has two substantially parallel outer surfaces which are coplanar with two substantially parallel outer surfaces of the second body segment in both the first, transformed and second, untransformed positions.

5. A transformable block toy according to claim 1, wherein the first and second body segments have outer surfaces which are parallel in one of the first, transformed and second, untransformed positions and nonparallel in the other of the first, transformed and second, untransformed positions.

6. A transformable block toy according to claim 1, wherein the first and second body segments collectively have a substantially polyhedron-shape in the first, transformed position and a substantially parallelepiped shape in the second, untransformed position.

7. A transformable block toy according to claim 1, wherein the first geometric shape is a polyhedron and the second geometric shape is a different polyhedron.

* * * * *